US006961533B2

(12) United States Patent
Sano et al.

(10) Patent No.: US 6,961,533 B2
(45) Date of Patent: Nov. 1, 2005

(54) IMAGE HEAT APPARATUS WITH FIRST AND SECOND ROTATABLE MEMBERS FORMING NIP TOGETHER WITH EXTERNAL HEATING ROTATABLE MEMBER

(75) Inventors: Tetsuya Sano, Shizuoka (JP); Hideki Kotsuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/685,450

(22) Filed: Oct. 16, 2003

(65) Prior Publication Data

US 2004/0114975 A1 Jun. 17, 2004

(30) Foreign Application Priority Data

Oct. 18, 2002 (JP) ..... 2002-303953
Oct. 2, 2003 (JP) ..... 2003-344518

(51) Int. Cl.[7] ..... G03G 15/20
(52) U.S. Cl. ..... 399/330; 219/216
(58) Field of Search ..... 399/330, 335, 399/320; 219/469–471, 216

(56) References Cited

U.S. PATENT DOCUMENTS

| | | | | |
|---|---|---|---|---|
| 4,001,544 | A * | 1/1977 | Heinzer et al. | 219/216 |
| 4,079,227 | A * | 3/1978 | Takiguchi | 219/216 |
| 4,218,499 | A * | 8/1980 | Shinohara et al. | 219/216 |
| 4,928,148 | A * | 5/1990 | Higashi | 219/469 |
| 4,984,027 | A * | 1/1991 | Derimiggio et al. | 219/469 |
| 5,019,692 | A * | 5/1991 | Nbedi et al. | 219/469 |
| 5,881,349 | A | 3/1999 | Nanataki et al. | 399/328 |
| 5,940,655 | A | 8/1999 | Sano et al. | 399/69 |
| 5,970,299 | A | 10/1999 | Sano et al. | 399/330 |
| 6,031,215 | A | 2/2000 | Nanataki et al. | 219/619 |
| 6,049,691 | A | 4/2000 | Abe et al. | 399/330 |
| 6,072,964 | A | 6/2000 | Abe et al. | 399/69 |
| 6,088,549 | A | 7/2000 | Kagawa et al. | 399/67 |
| 6,246,843 | B1 | 6/2001 | Nanataki et al. | 399/45 |
| 6,343,195 | B1 | 1/2002 | Abe et al. | 399/69 |
| 6,347,201 | B1 | 2/2002 | Sano et al. | 399/67 |
| 6,795,677 | B2 * | 9/2004 | Berkes et al. | 219/216 |
| 6,835,918 | B2 * | 12/2004 | Kagawa et al. | 219/469 |
| 6,853,831 | B2 * | 2/2005 | Hirst et al. | 399/330 |
| 2002/0044789 | A1 | 4/2002 | Nanataki et al. | 399/69 |
| 2003/0058320 | A1 | 3/2003 | Sano et al. | 347/103 |

FOREIGN PATENT DOCUMENTS

| | | |
|---|---|---|
| JP | 10-69176 | 3/1998 |
| JP | 10-133505 | 5/1998 |
| JP | 11-24489 | 1/1999 |
| JP | 2002-62752 | 2/2002 |
| JP | 2002-236429 | 8/2002 |

* cited by examiner

*Primary Examiner*—Susan Lee
(74) *Attorney, Agent, or Firm*—Fitzpatrick, Cella, Harper & Scinto

(57) ABSTRACT

An image heating apparatus includes a first rotatable member, a second rotatable member contacting the first rotatable member, wherein a recording material passes between the first rotatable member and the second rotatable member, and a heating unit for heating the first rotatable member and having a third rotatable member contacting a surface of the first rotatable member, wherein releasability of a surface of the third rotatable member is higher than releasability of a surface of the second rotatable member. Thus, the image heating apparatus heats an image forming on a recording material without contaminating an external heating apparatus.

9 Claims, 5 Drawing Sheets

IMAGE HEAT APPARATUS WITH FIRST AND SECOND ROTATABLE MEMBERS FORMING NIP TOGETHER WITH EXTERNAL HEATING ROTATABLE MEMBER

BACKGROUND OF THE INVENTION

1. Field of the Invention

The present invention relates to an image heating apparatus for heating an image recorded on a recording material, and more particularly to an image heating apparatus adapted for use as a heat fixation apparatus to be mounted in a copying apparatus or a printer employing an electrophotographic recording technology or an electrostatic recording technology.

2. Related Background Art

A heat fixation apparatus employed in recent copying apparatus or printer is required to secure a satisfactory fixing property with an even less electric power consumption.

For attaining such performance, there is, for example, known a fixing apparatus of an external heating method as disclosed in Japanese Patent Application Laid-open No. H10-133505. Such fixing apparatus is provided with a fixing roller, a pressure roller for forming a recording material conveying nip portion together with the fixing roller, and a heating roller for heating an external periphery of the fixing roller, wherein the fixing roller is equipped with an elastic layer for obtaining a nip width for securing the fixing property and the fixing roller is heated from a surface thereof in order to promptly raise the surface of the fixing roller to a fixing temperature.

However, in the above-described method of heating the surface of the fixing roller from the exterior, a smear on an external heating roller is a concern.

In the recording material conveying nip of the fixing apparatus, there generally stands a relationship "adhesive force between toner and recording material">"adhesive force between the surface of fixing roller or pressure roller and toner." As a result, the toner does not stick to the surface of the fixing roller but to the recording material.

On the other hand, in case of a detection of an abnormal situation such as a sheet jam, an image forming apparatus suspends its operation and terminates the operation of a heater etc. for security. In such situation, if a sheet bearing an unfixed toner is present in the fixing nip portion, the toner may be deposited (offset) onto the surface of the fixing roller by a temperature decrease of the roller. Also a toner deposition may occur on the fixing roller at a jam resolving procedure by the user.

In a conventional fixing apparatus without an external heating member, even in case the surface of the fixing roller or the pressure roller is smeared with an offset toner, for example, by a sheet jam, the aforementioned relationship of forces is restored when the apparatus returns to a normal state, whereby the offset toner on the fixing roller or the pressure roller is fixed onto a first passed sheet and can therefore be removed from the roller.

However, in a fixing apparatus provided with an external heating member, the offset toner resulting, for example, in a sheet jam may also stick to an external heating roller. In such case, in a first passed sheet after jam processing, the toner on the external heating roller, not coming in direct contact with the recording material, cannot be removed completely. The toner remaining on the external heating roller returns onto the fixing roller irregularly, thus smearing an image on the recording material.

In order to avoid such drawbacks, it is also proposed to provide a cleaning member in contact with the fixing roller or the external heating roller thereby eliminating the offset toner, but the apparatus becomes larger and more complex and the cleaning member has to be replaced periodically by the user.

SUMMARY OF THE INVENTION

The present invention has been made in consideration of the foregoing and an object of the present invention is to provide an image heating apparatus in which external heating means is not easily smeared.

Another object of the present invention is to provide an image heating apparatus including:

a first rotatable member;

a second rotatable member in contact with the first rotatable member, where a recording material passes between the first rotatable member and the second rotatable member; and heating means which heats the first rotatable member, the heating means includes a third rotatable member maintained in contact with a surface of the first rotatable member;

wherein a surface of the third rotatable member has a releasing property higher than that of a surface of the second rotatable member.

Still other objects of the present invention will become fully apparent from the following detailed description to be taken in conjunction with the accompanying drawings.

DESCRIPTION OF THE PREFERRED EMBODIMENTS (Embodiment 1)

Figure 1:
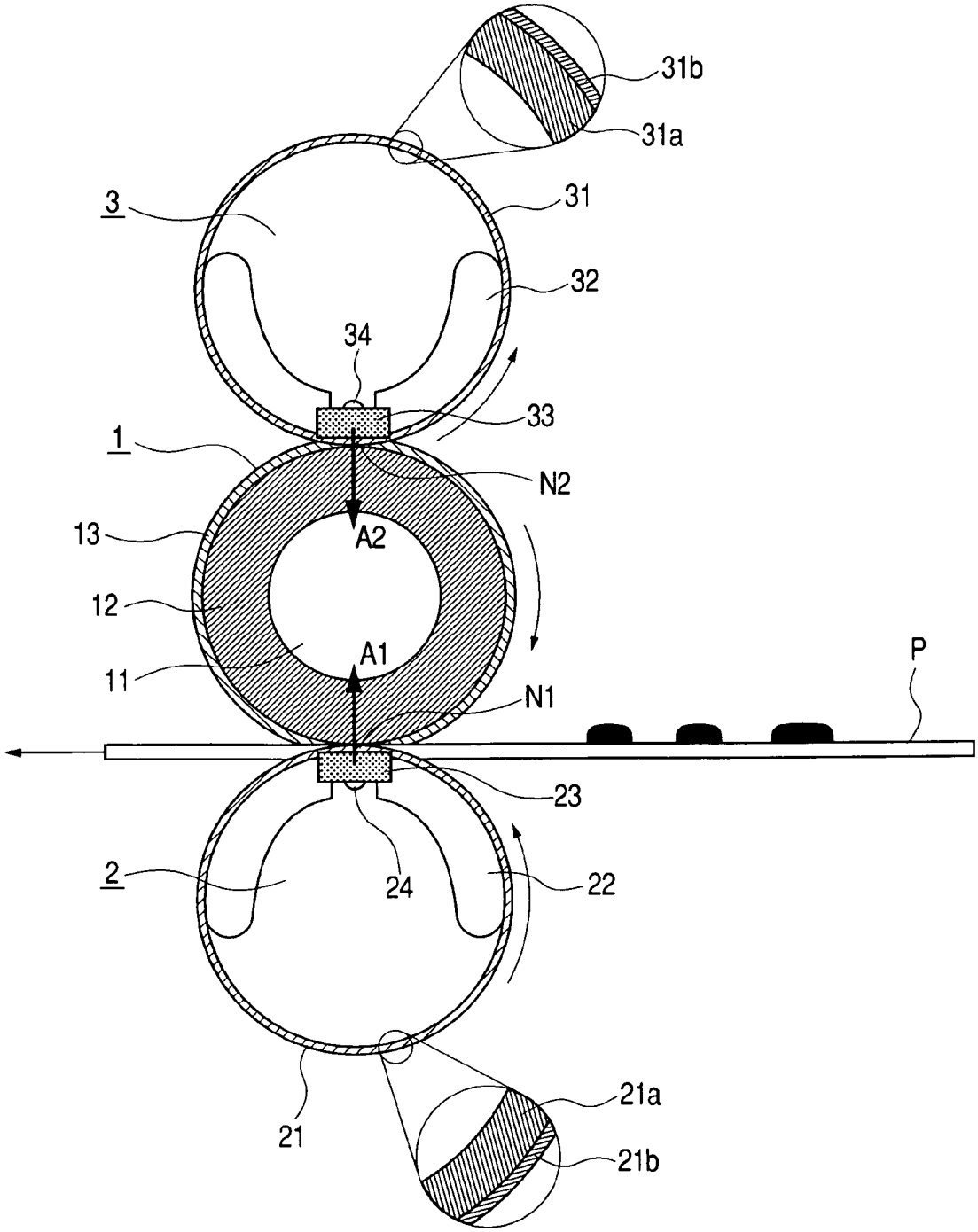
FIG. 1 is a cross-sectional view of a fixing apparatus of a first embodiment.

FIG. 1 is a view schematically showing the configuration of a fixing apparatus constituted by an image heating apparatus embodying the present invention.

A fixing roller 1 constitutes a first rotary member having an elastic layer. In the present embodiment, the fixing roller 1 is formed by, on an external periphery of an aluminum metal core 11 of an outer diameter 17 mm, a heat resistant elastic layer 12 such as of silicone rubber or fluorinated rubber with a thickness of 3 to 5 mm, and further thereon a releasing layer 13 constituted of a resin coated layer such as of PFA (perfluoroalkyl-vinyl-ether copolymer) or PTFE (polytetra fluoroethylene) of a thickness of 50 $\mu$m.

In addition to the fixing roller, there are provided a pressure unit 2 formed by a film guide 22, a ceramic heater 23 constituting a heat generating member fixed and supported by the film guide 22, and a cylindrical endless film (second rotary member) 21 of an external diameter of 24 mm, loosely fitted on the film guide 22 bearing the heater 23. The pressure unit 2 is positioned under the fixing roller 1 with the heater 23 opposed to a lower surface of the fixing roller 1 and parallel to the fixing roller 1, and the film guide 22 is pressurized by unrepresented pressurizing means with a total pressure of 147 N (15 kgf) in a direction A1 against the elasticity of the fixing roller 1, thereby forming a fixing nip portion N1 between the heater 23 and the fixing roller 1 and across the film 21. A thermistor 24 is provided on the ceramic heater 23 in a surface thereof not in contact with the film 21.

An external heating unit (heating means) 3 is provided, as in the aforementioned pressure unit 2, with a film guide 32, a ceramic heater 33 constituting a heat generating member fixed and supported by the film guide 32, and a cylindrical endless film (third rotary member) 31 of an external diameter of 24 mm, loosely fitted on the film guide 32 bearing the heater 33. The external heating unit 3 is positioned on the fixing roller 1 with the heater 33 opposed to an upper surface of the fixing roller 1 and parallel to the fixing roller 1, and the film guide 32 is pressurized by unrepresented pressurizing means with a total pressure of 147 N (15 kgf) in a direction A2 against the elasticity of the fixing roller 1, thereby forming a heating nip portion N2 between the heater 33 and the fixing roller 1 and across the film 31. A thermistor 34 is provided on the ceramic heater 33 in a surface thereof not in contact with the film 31.

The fixing roller 1 is rotated by clockwise as indicated by an arrow with a predetermined peripheral speed, by unrepresented drive means.

The rotation of the fixing roller 1 causes the cylindrical film 21 of the pressure unit 2 to be rotated. More specifically, when the fixing roller 1 is rotated, the cylindrical film 21 is rotated around the film guide 22, by a frictional force at the fixing nip portion N1, with an internal surface in sliding contact with an upward surface of the heater 23 in the fixing nip portion N1 and with a peripheral speed substantially corresponding to the peripheral speed of the fixing roller 1.

Also the rotation of the fixing roller 1 causes the cylindrical film 31 of the external heating unit 3 to be rotated. More specifically, when the fixing roller 1 is rotated, the cylindrical film 31 is rotated around the film guide 32, by a frictional force at the heating nip portion N2, with an internal surface in sliding contact with a downward surface of the heater 33 in the heating nip portion N2 and with a peripheral speed substantially corresponding to the peripheral speed of the fixing roller 1.

Each of the ceramic heaters 23, 33 constituting the heat generating members in the pressure unit 2 and the external heating unit 3 is of a width of 8 mm, a thickness of 1 mm and a heat generation amount (rated electric power) of 600 W, and is temperature controlled by an unrepresented heater drive circuit at a predetermined temperature based on a temperature detected by the thermistor 24 or 34, whereby the fixing roller 1 is heated from the surface thereof in the fixing nip portion N1 and the heating nip portion N2 respectively through the films 21 and 31, thereby being maintained at a predetermined temperature.

A recording material P, bearing an unfixed image, is conveyed in a direction indicated by an arrow, and passes through the fixing nip portion N1 (having a width of about 8 mm in the conveying direction of the recording material) where the fixing roller 1 and the pressure unit 2 are mutually contacted. In the fixing nip portion N1, the recording material is heated under a pressure whereby the image is fixed. The external heating unit 3 is not in contact with the recording material P.

In the present embodiment, each of the film (second rotary member) 21 and the film (third rotary member) 31 is formed by a substrate 21*a* (or 31*a*) of a thickness of 50 $\mu$m formed by polyimide resin or the like, coated with a highly releasing material such as PFA resin with a thickness of 10 $\mu$m to form a releasing layer 21*b* (or 31*b*).

The film guides 22 and 32 are formed with a material of a high insulating property and a high heat resistance such as polyimide resin or LCP resin.

In the present embodiment, as explained in the foregoing, rotary members of the pressure unit and the heating unit are formed by flexible film-shaped members whereby a heat capacity of the entire fixing apparatus can be reduced to shorten a waiting time such as for a pre-rotation step for elevating the surface temperature of the fixing roller 1 before sheet passing (quick starting property) and also to significantly reduce an electric power consumption in a stand-by state (power saving).

When a heating operation was actually executed in the fixing apparatus of the present embodiment, the surface temperature of the fixing roller could be elevated from the room temperature (23° C.) to a predetermined fixing temperature (180° C.).

On the other hand, in the present embodiment, the releasing layer 21*b* of the film 21 of the pressure unit 2 and the releasing layer 31*b* of the film 31 of the external heating unit 3 were formed by a same material, but a substance mixed in such material was changed in an amount or a type to obtain a releasing property of the releasing layer 31*b* higher than that in the releasing layer 21*b*.

More specifically, in the present embodiment, the releasing layer 21*b* of the film 21 and the releasing layer 31*b* of the film 31 were both formed with a PFA resin but a difference in the releasing property was obtained in the following manner.

The releasing layer 31*b* was formed with a pure PFA resin, while the releasing layer 21*b* was formed by dispersing a small amount of carbon particles as a mixed substance in the PFA resin.

The PFA resin generally has a high releasing property, but the releasing property (releasability) is lowered by mixing another substance of a lower releasing property. Carbon was selected as the mixed substance since a substance stable at a high temperature is preferable in the fixing apparatus and also in order to improve a thermal response thereof.

It is also possible to obtain a difference in the releasing property, by employing a conductive filler such as titanium oxide as the mixed substance instead of carbon.

The film 21 (releasing layer 21*b*) and the film 31 (releasing layer 31*b*) of the present embodiment had a contact angle to purified water, measured in a "3-point click method" by a contact angle meter of Kyowa Kaimen Kagaku Co., of 100° and 110° respectively.

The contact angle to purified water is generally correlated with the releasing property of toner, and a larger contact angle provides a better releasing property. In fact, in a comparison of test pieces of the film 21 (releasing layer 21*b*) and the film 31 (releasing layer 31*b*) for the releasing property for the toner of the present embodiment, the releasing layer 31*b* showed a better releasing property than in the releasing layer 21*b*.

By adjusting the material constituting the releasing layers of the film of the pressure unit and that film of the external heating unit with the amount or the nature of the mixed substance to be added to such material in such a manner that the releasing property of the external heating unit is higher than that of the pressure unit, whereby an offset toner deposited at a jam processing etc. can be deposited on the film surface 21*b* of the pressure unit rather than on the film surface 31*b* of the external heating unit.

In the following there will be explained a reason why a toner deposition on the third rotary member can be suppressed by selecting the releasing property of the third rotary member (film of the external heating unit) higher than that of the second rotary member (film of the pressure unit).

In the following description, there is assumed a situation where a jam of the recording material occurs in the course of a continuous printing operation on plural recording material and an electric power supply to the heater of the fixing apparatus and the rotation of the rotary members are interrupted in a state in which the toner is deposited on the first to third rotary members. In the apparatus of the present embodiment, when the jammed recording material is judged to be removed from the fixing apparatus, there is initiated a recovering operation for re-starting the power supply to the two heaters and re-starting the rotation of the rotary member so as to bring the fixing apparatus to an operable state. In the present embodiment, the offset toner is removed at such recovering operation, and a behavior of the offset toner at the recovering operation will be explained in the following. With the start of the recovering operation, the heaters of the heating unit and of the pressure unit are activated to a fusing temperature of the toner, and, in the present embodiment, the two heaters have a controlled temperature of 180° C. and the recovering operation requires about 15 seconds from the start to the completion thereof (about 5 rotations of the fixing roller). Heating of the toner to the fusing temperature provides an effect of facilitating a toner transfer from the rotary member of a higher releasing property to the rotary member of a lower releasing property. Also in the present embodiment, a recording material not bearing an image is automatically passed at the end of the period of the recovering operation, whereby the offset toner is eliminated with such recording material. After such recording material for removing the offset toner (being an ordinary recording material which merely does not bear an image) passes through the fixing nip portion, the fixing operation for the remaining recording materials in the continuous printing operation is re-started.

The behavior of the offset toner in a recovering operation varies depending on a relative relationship of the surface releasing properties of the first rotary member (fixing roller), the second rotary member (film of the pressure unit) and the third rotary member (film of the external heating unit), but, in any case, it is possible, by maintaining the releasing property of the third rotary member higher than that of the second rotary member, to return the toner deposited on the third rotary member which is not in direct contact with the recording to the recording material at the recovering operation.

Figure 2:
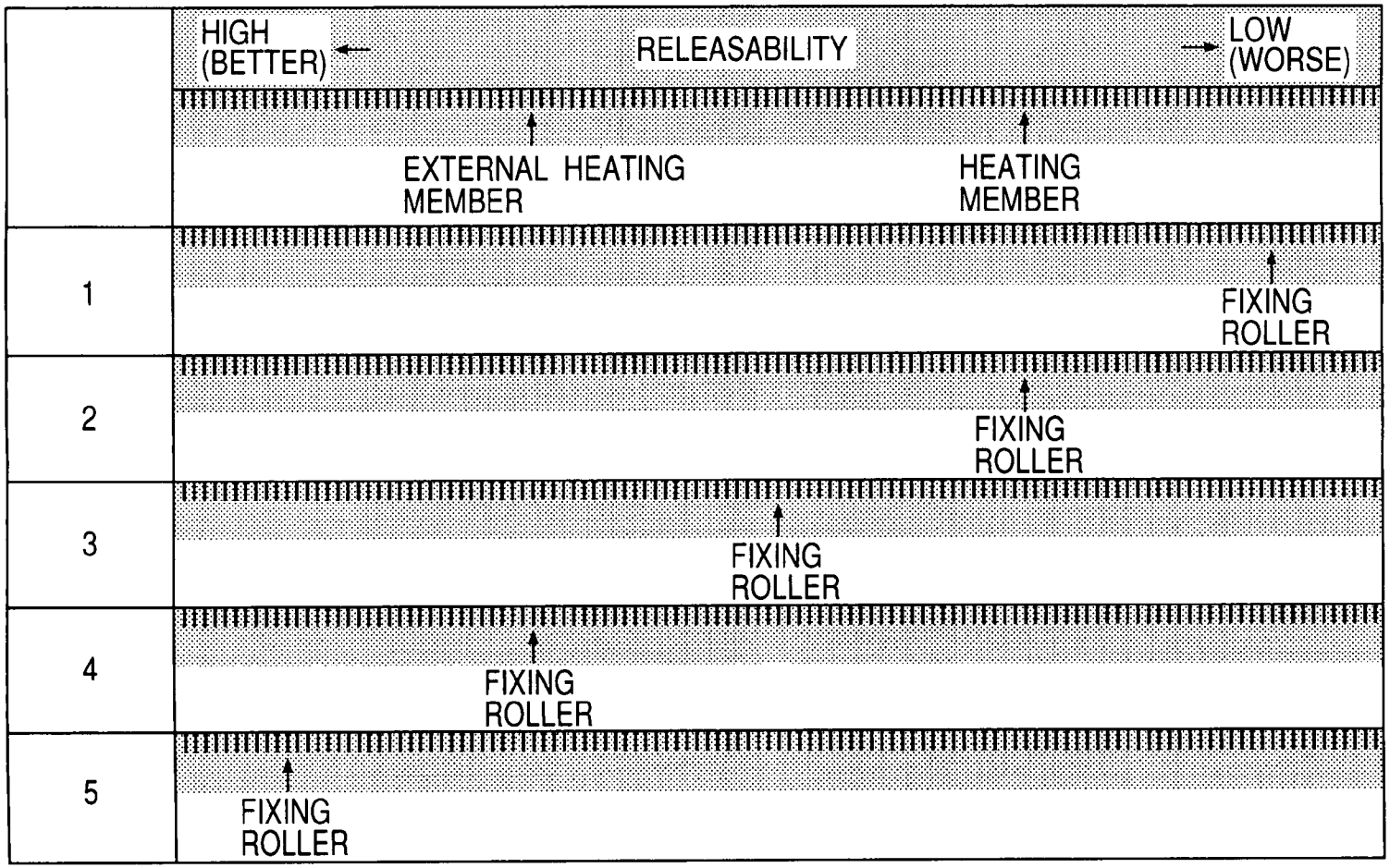
FIG. 2 is a schematic view showing a relationship of releasing property of rotary members in the first embodiment.

FIG. 2 shows a relative relationship of the releasing property of the film of the external heating unit, the film of the pressure unit and the fixing roller in case the releasing property of the film of the external heating unit is made higher than that of the film of the pressure unit.

In case the releasing property of the film of the external heating unit is higher than that of the film of the pressure unit, the releasing properties of the external heating unit, the pressure unit and the fixing roller may assume one of following five cases shown in FIG. 2:

1) case 1: "high">"releasing property of external heating unit">"releasing property of pressure unit">"releasing property of fixing roller">"low";
2) case 2: "high">"releasing property of external heating unit">"releasing property of fixing roller"="releasing property of pressure unit">"low";
3) case 3: "high">"releasing property of external heating unit">"releasing property of fixing roller">"releasing property of pressure unit">"low";
4) case 4: "high">"releasing property of external heating unit"="releasing property of fixing roller">"releasing property of pressure unit">"low";
5) case 5: "high">"releasing property of fixing roller">"releasing property of external heating unit">"releasing property of pressure unit">"low."

For example in the case 1 with a relationship: "high">"releasing property of external heating unit">"releasing property of fixing roller">"low," the offset toner transferred to the external heating unit moves to the fixing roller at the start of heating in the recovering operation, because of such relationship. Also because of a relationship: "high">"releasing property of pressure unit">"releasing property of fixing roller">"low," the offset toner transferred to the pressure unit also moves to the fixing roller thereby being collected thereon (removed from the external heating unit). Then by the passing of a recording material at the end of the recovering operation, the collected toner is deposited on the recording material (on a surface at the side of the fixing roller). In this manner, the toner on the external heating unit can be removed.

In the case 2, because of a relationship: "high">"releasing property of external heating unit">"releasing property of fixing roller">"low," the offset toner transferred to the external heating unit moves to the fixing roller at the start of heating in the recovering operation (eliminated from the external heating unit). Also because of a relationship: "high">"releasing property of fixing roller"="releasing property of pressure unit">"low," the offset toner behaves to reciprocate between the fixing roller and the pressure unit. Then by the passing of a recording material for toner elimination, the toner reciprocating between the fixing roller and the pressure unit is deposited on both surfaces of the recording material. In this manner, the toner on the external heating unit can be removed.

In the case 3, because of a relationship: "high">"releasing property of external heating unit">"releasing property of fixing roller">"low," the offset toner transferred to the external heating unit moves to the fixing roller at the start of heating in the recovering operation (eliminated from the external heating unit). Also because of a relationship: "high">"releasing property of fixing roller">"releasing property of pressure unit">"low," the offset toner further moves to the pressure unit and is collected thereon. Then by the passing of a recording material for toner elimination, the collected toner is deposited on the recording material (a surface at the side of the pressure unit). In this manner, the toner on the external heating unit can be removed.

In the case 4, because of a relationship: "high">"releasing property of external heating unit"="releasing property of fixing roller">"low," the offset toner transferred to the external heating unit behaves to reciprocate between the external heating unit and the fixing roller in an early stage after the start of heating in the recovering operation. Also because of a relationship: "high">"releasing property of fixing roller">"releasing property of pressure unit">"low," the toner reciprocating between the external heating unit and the fixing roller gradually moves to the pressure unit and is finally collected in the pressure unit (eliminated from the external heating unit). Then by the passing of a recording material for toner elimination, the toner collected on the pressure unit is deposited on the recording material (a surface at the side of the pressure unit). In this manner, the toner on the external heating unit can be removed.

In the case 5, because of a relationship: "high">"releasing property of fixing roller">"releasing property of external heating unit"> "low," the offset toner transferred to the external heating unit does not easily move to the fixing roller, and in an early stage of the recovering operation, the toner deposited on the fixing roller inversely moves to the external heating unit. In such situation, by sufficiently heating the external heating unit for example by controlling the external heating unit at a higher temperature, it is possible to move the offset toner, transferred to the external heating unit, temporarily to the fixing roller of a lower temperature. The toner, thus temporarily transferred to the fixing roller, comes into contact with the pressure unit by rotation, before it arrives again at the external heating unit. Then, because of a relationship: "high">"releasing property of fixing roller">"releasing property of pressure unit">"low," the toner moves to the pressure unit and is collected therein the pressure unit. Thus, the toner on the external heating unit temporarily moves to the fixing roller, then further moves therethrough to the pressure unit and collected therein. Such process is repeated whereby the offset toner transferred to the external heating unit is gradually collected in the pressure unit and finally collected completely in the pressure unit (eliminated from the external heating unit). Then by the passing of a recording material for toner elimination, the toner collected on the pressure unit is deposited on the recording material (a surface at the side of the pressure unit). In this manner, the toner on the external heating unit can be removed.

It is thus possible, as in the case 5, to positively control the behavior of the toner by optimizing not only the releasing property but also a heating condition (temperature) etc., and also possible to adopt a configuration capable of eliminating the offset toner, transferred to the external heating unit, more efficiently through a combination with the relationship of the releasing property.

As explained in the foregoing, the toner behaves differently at the initial stage of the recovering operation according to the relationship of the releasing property of the fixing roller, the pressure unit and the external heating unit, but it is possible, by the recovering operation, to move the offset toner transferred to the external heating unit to a unit of a lower releasing property than in the external heating unit and to finally eliminate such toner by deposition onto the passed recording material.

Particularly in a configuration of collecting the toner in the pressure unit as in the case 3, 4 or 5, the offset toner can be deposited on the rear surface (at the side of the pressure unit) of the recording material. Such configuration is preferred since the image bearing surface is not smeared even when the recording material for toner elimination is not passed but the offset toner is eliminated by a first (image-bearing) recording material after the printing operation is re-starting. Also the cases 1 to 4 are preferable in that a complex heating condition is not required during the recovering operation.

It is also possible to adopt a configuration of eliminating a smear other than in a jam state, by collecting the smear in the pressure unit side, utilizing an interval between the sheets in a continuous printing operation under an ordinary heating condition and returning the smear to an image non-bearing surface of a passed sheet.

In fact, in the aforementioned cases 1 to 5, each of the fixing roller, the external heating unit and the pressure unit was forcedly smeared with toner, and the behavior of the toner in the recovering operation was confirmed. In any of these cases, the offset toner, transferred to the external heating unit not in direct contact with the recording material, could be eliminated and returned to the recording material by the recovering operation.

Figure 3:
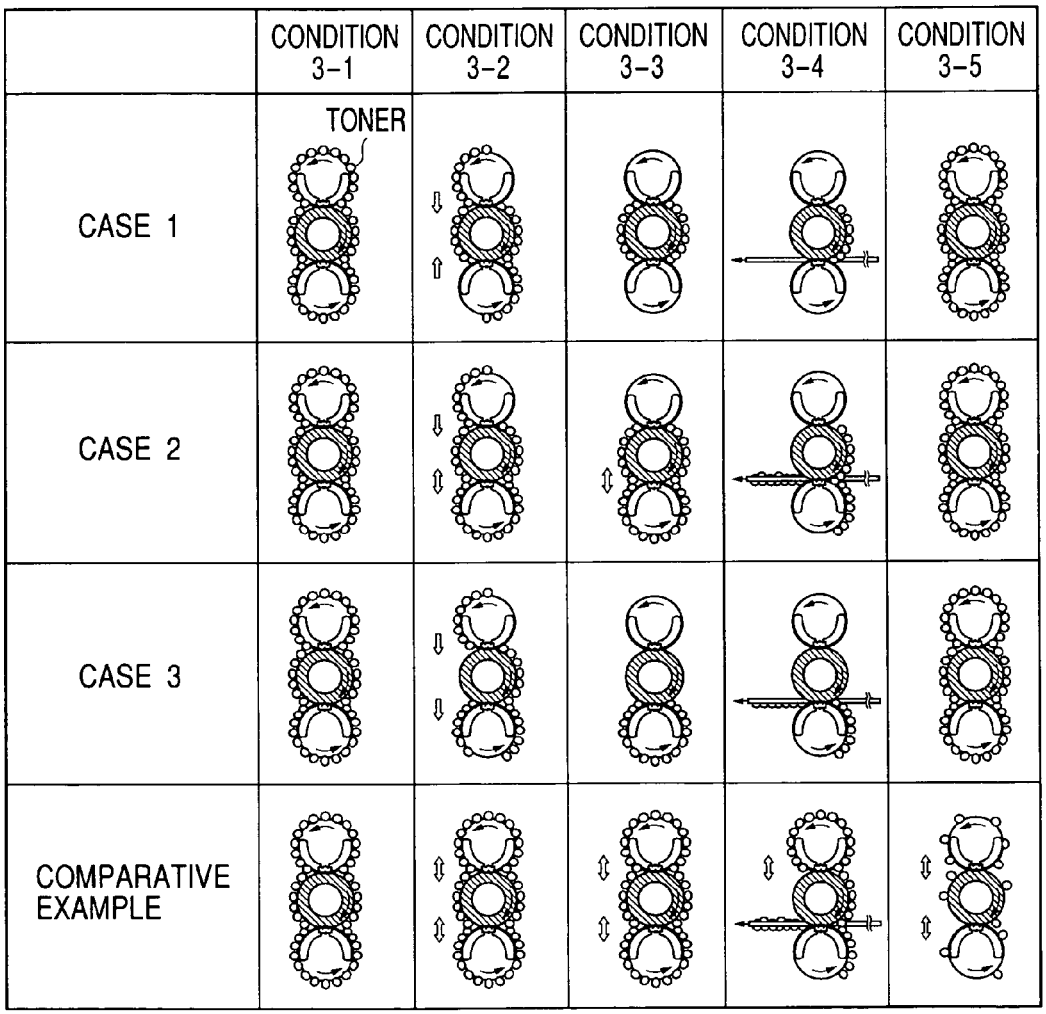
FIG. 3 is a view showing a toner behavior in a recovering operation in the first embodiment.

FIG. 3 schematically shows the toner behavior in the recovering operation, in the cases 1, 2 and 3 as representative examples. There is also shown a comparative example in which the external heating unit, the pressure unit and the fixing roller have a same releasing property (i.e., releasing property of the external heating unit, releasing property of the pressure unit and releasing property of the fixing roller). Also for each case, there are shown a smeared state (condition 3-1), a state in an early stage after the start of the recovering operation (condition 3-2), a state during the recovering operation (condition 3-3), a state during a sheet passing in the recovering operation (condition 3-4), and a state after the sheet passing in the recovering operation (condition 3-5).

In the case 1, because of the releasability relationship: "high">"releasing property of external heating unit">"releasing property of pressure unit">"releasing property of fixing roller">"low," with the start of the rotation and the heating operation as the recovering operation in the smeared state with the toner (condition 3-1), the toner on the external heating unit and that on the pressure unit start to move to the fixing roller and are collected thereon (condition 3-2). Then, by repeating the heating and the rotation for a certain time, the toner on the external heating unit and on the pressure unit are all collected on the fixing roller and are eliminated from the external heating unit and the pressure unit (condition 3-3). Then, by passing the recording material for toner elimination, the toner collected on the fixing roller is deposited on the surface of the recording material at the side of the fixing roller (conditions 3-4, 3-5). In this manner the toner on the external heating unit was eliminated.

In the case 2, because of the releasability relationship: "high">"releasing property of external heating unit">"releasing property of fixing roller"="releasing property of pressure unit">"low," with the start of the rotation and the heating operation as the recovering operation in the smeared state with the toner (condition 3-1), the toner on the external heating unit starts to move to the fixing roller, and the toner on the fixing roller and the toner on the pressure unit reciprocate between the two (condition 3-2). Then, by repeating the heating and the rotation for a certain time, the toner on the external heating unit is all collected on the pressure unit or on the fixing roller, and is eliminated from the external heating unit (condition 3-3). Then, by passing the recording material for toner elimination, the toner collected on the pressure unit or on the fixing roller is deposited on both surfaces of the recording material (conditions 3-4, 3-5). In this manner the toner on the external heating unit was eliminated.

In the case 3, because of the releasability relationship: "high">"releasing property of external heating unit">"releasing property of fixing roller">"releasing property of pressure unit">"low," with the start of the rotation and the heating operation as the recovering operation in the smeared state with the toner (condition 3-1), the toner on the external heating unit starts to move to the fixing roller, while the toner on the fixing roller starts to move to the pressure and is collected thereon (condition 3-2). Then, by repeating the heating and the rotation for a certain time, all the toner is collected on the pressure unit, and is eliminated from the external heating unit and the fixing roller (condition 3-3).

Then, by passing the recording material for toner elimination, the toner collected on the pressure unit is deposited on the surface of the recording material at the side of the pressure unit (conditions 3-4, 3-5). In this manner the toner on the external heating unit was eliminated.

On the other hand, in the comparative example in which the external heating unit, the pressure unit and the fixing roller have a same releasing property, in the rotation of the recovering operation in the smeared state with the toner (condition 3-1), the toner irregularly move among the three members. Therefore, even after repeating the heating and the rotation for a certain time, the toner irregularly move among the three and the toner on the external heating unit cannot be eliminated completely (conditions 3-2, 3-3). Consequently, by the sheet passing in the recovering operation, a part of the toner (on the fixing roller and the pressure unit) was returned to the image bearing surface and the image non-bearing surface of the recording material, but the toner on the external heating unit, which is not in contact with the recording material remained without being returned to the recording material (condition 3-4, 3-5). As a result, in an image forming operation after the recovering operation, the toner again moved irregularly among the three members, and resulted in an image defect.

In a sheet passing durability test on the fixing apparatus of the present embodiment, it was possible, even in case the toner was transferred to the external heating unit for example by a jam, to eliminate such offset toner thereby preventing an image defect resulting from such offset, and maintaining satisfactory fixing property for a prolonged period.

In summary of the foregoing, among the releasing properties of the three rotary members, it is necessary that the releasing property of at least the third rotary member (external heating unit) is higher than the releasing property of the second rotary member (pressure unit). Also, in consideration of a fact that the toner can be eliminated by the rear side of the recording material even without the sheet passing for the cleaning of the fixing apparatus and that the offset toner can be eliminated by an image-bearing recording material, it is more preferred that the releasing property of the first rotary member (fixing roller) is higher than the releasing property of the second rotary member (pressure roller). Also in consideration of a fact that a complex heating condition is not required in the recovering operation, it is preferred that the releasing property of the first rotary member (fixing roller) is lower than the releasing property of the third rotary member (external heating unit). Consequently it is most preferable that the releasing property is highest in the third rotary member, then higher in the first rotary member and lowest in the second rotary member.

(Embodiment 2)

The fixing apparatus of the present embodiment is similar in the approximate configuration to that of the first embodiment, so that similar portions will not be explained further.

In the present embodiment, the releasing layer 21*b* of the film of the pressure unit and the releasing layer 31*b* of the film of the external heating unit have both high releasing properties, but are formed with different material, in such a manner that the releasing layer 31*b* of the film of the external heating unit is higher in the releasing property than the releasing layer 21*b* of the film of the pressure unit.

More specifically, in the present embodiment, the releasing layer 21*b* was formed by fluorinated rubber while the releasing layer 31*b* was formed by PFA resin, each coated with a thickness of 10 $\mu$m on a substrate.

As a result, the releasing layer 21*b* of the film of the pressure unit and the releasing layer 31*b* of the film of the external heating unit respectively had contact angles to purified water of 105° and 115°.

It is thus possible to eliminate the offset toner from the third rotary member, by employing different material in at least the third rotary member (external heating unit) and the second rotary member (pressure unit) thereby obtaining a higher releasing property in the third rotary member. In particular, by forming the pressure unit and the external heating unit with members of a low heat capacity and selecting the releasing property of the external heating unit higher than that of the pressure unit, it is rendered possible to shorten a waiting time such as for a pre-rotation step for elevating the surface temperature of the fixing roller to the target temperature before sheet passing as in the embodiment 1, and also to deposit the offset toner, for example, resulting in a jam processing, onto the film surface 21*b* of the pressure unit rather than the film surface 31*b* of the external heating unit.

The offset toner deposited on the surface of the fixing roller for example by a jam comes into contact with the external heating unit and the pressure unit by the rotation of the roller in a jam process and in a recovering operation, but tends to be deposited on the pressure unit because the releasing property is higher in the external heating unit than in the pressure unit.

It is thus made possible to collect the offset toner on the pressure unit for example in a recovering operation, and to return the offset toner onto the recording material in a first sheet passing after the recovering operation (even in case the offset toner is temporarily transferred to the external heating unit, it can be moved to the pressure unit and eliminated by a sheet passing).

As a result, it is possible to prevent an image defect in second and subsequent sheets, thereby avoiding the image defect resulting from the offset toner deposited for example in a jam and maintaining the satisfactory fixing property over a prolonged period.

Also since the offset toner is moved to the pressure unit and returned to an image non-bearing rear surface of the recording material at a sheet passing, the image-bearing surface is not smeared and an image of a permissible level can be obtained even in a first passed sheet in case the amount of the offset toner is small.

In a start-up test (heating operation from the room temperature) in the present embodiment as in the embodiment 1, the surface temperature of the fixing roller could be elevated from the room temperature (23° C.) to the predetermined temperature (180° C.) within 10 seconds.

Also in a sheet passing durability test in a similar manner, it was possible to present an image defect by an offsetting and to maintain a satisfactory fixing property over a prolonged period.

(Embodiment 3)

The fixing apparatus of the present embodiment is similar in the approximate configuration to that of the first and second embodiments, so that similar portions will not be explained further.

In the present embodiment, the surface of the film of the pressure unit and the surface of the film of the external heating unit have both high releasing properties, but are formed with surface layers of different surface properties, in such a manner that the film surface of the pressure unit is higher in the releasing property than the film surface of the external heating unit.

More specifically, in the present embodiment, the releasing layer 21*b* of the film of the pressure unit and the releasing layer 31*b* of the film of the external heating unit were both formed by PFA resin, and a surface roughness, for example represented by surface roughness Rz, Ra, of the releasing layer 21*b* of the film of the pressure unit was made larger than the surface roughness of the releasing layer 31*b* of the external heating unit.

As a result, the releasing layer 21*b* and the releasing layer 31*b* respectively had contact angles to purified water of 100° and 110°.

It is thus possible to eliminate the offset toner from the third rotary member, by employing different surface properties in at least the third rotary member (external heating unit) and the second rotary member (pressure unit) thereby obtaining a higher releasing property in the third rotary member. In particular, by forming the pressure unit and the external heating unit with members of a low heat capacity and regulating the surface roughness of the film of the pressure unit 2 and the film of the external heating unit 3 so as to obtain a higher releasing property in the external heating unit than in the pressure unit, it is rendered possible to shorten a waiting time such as for a pre-rotation step for elevating the surface temperature of the fixing roller to the target temperature before sheet passing as in the embodiment 1, and also to deposit the offset toner, for example, resulting in a jam processing, onto the film surface 21*b* of the pressure unit rather than the film surface 31*b* of the external heating unit.

The offset toner deposited on the surface of the fixing roller for example by a jam comes into contact with the external heating unit and the pressure unit by the rotation of the roller in a jam process and in a recovering operation, but tends to be deposited on the pressure unit because the releasing property is higher in the external heating unit than in the pressure unit.

It is thus made possible to collect the offset toner on the pressure unit for example in a recovering operation, and to return the offset toner onto the recording material in a first sheet passing after the recovering operation (even in case the offset toner is temporarily transferred to the external heating unit, it can be moved to the pressure unit and eliminated by a sheet passing).

As a result, it is possible to prevent an image defect in second and subsequent sheets, thereby avoiding the image defect resulting from the offset toner deposited, for example, in a jam and maintaining the satisfactory fixing property over a prolonged period.

Also since the offset toner is moved to the pressure unit and returned to an image non-bearing rear surface of the recording material at a sheet passing, the image-bearing surface is not smeared and an image of a permissible level can be obtained even in a first passed sheet in case the amount of the offset toner is small.

In a start-up test (heating operation from the room temperature) in the present embodiment as in the embodiment 1, the surface temperature of the fixing roller could be elevated from the room temperature (23° C.) to the predetermined temperature (180° C.) within 10 seconds.

Also in a sheet passing durability test in a similar manner, it was possible to present an image defect by an offsetting and to maintain a satisfactory fixing property over a prolonged period.

In particular, the surface of the external heating unit, being free from contact with the recording material, can be prevented from a deterioration of the surface property by sheet passing, whereby the surface property could be maintained in satisfactory manner throughout the durability test.

(Embodiment 4)

Figure 4:
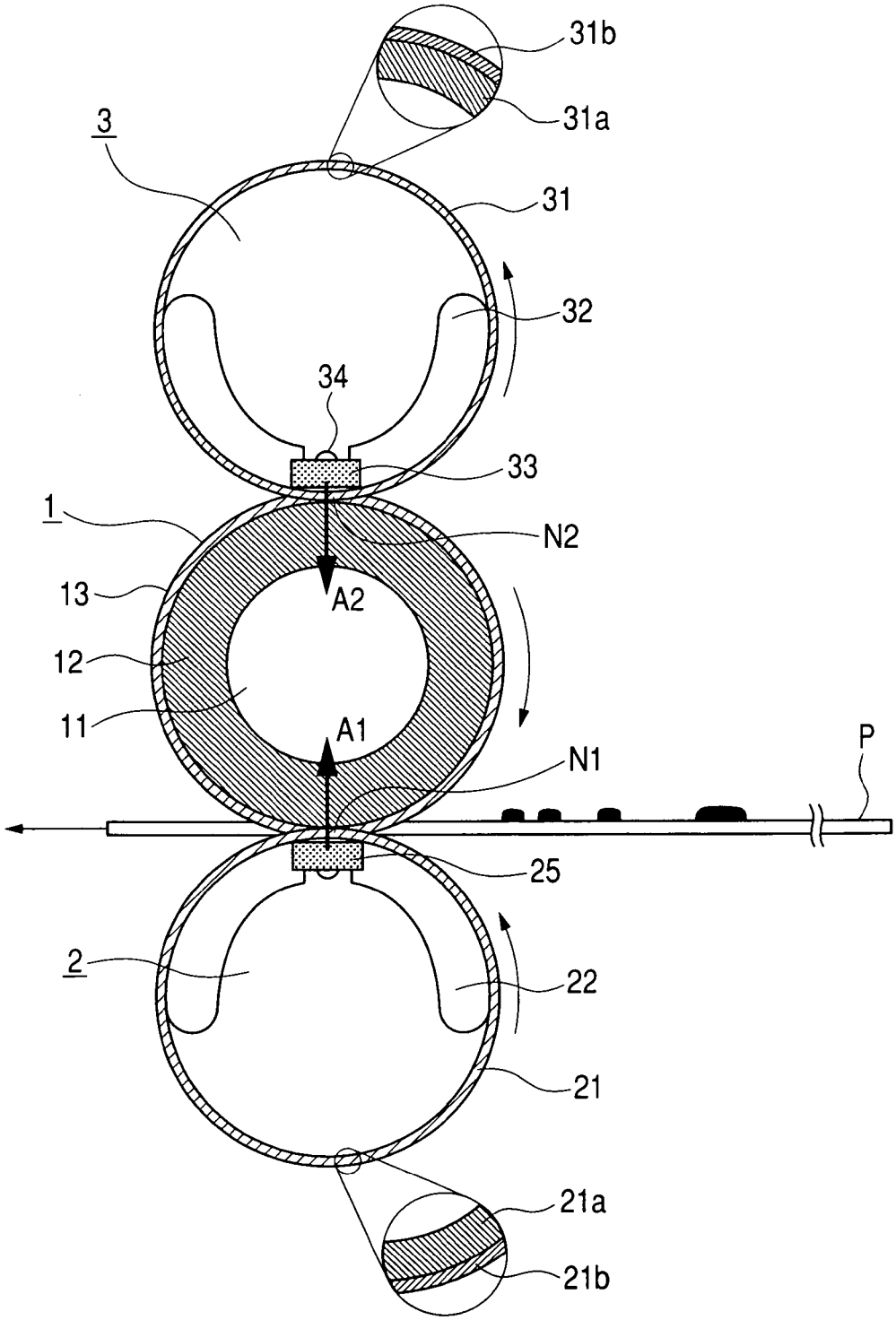
FIG. 4 is a cross-sectional view of a fixing apparatus of a fourth embodiment.

FIG. 4 shows a fourth embodiment. In this embodiment, the heater at the pressure unit side is replaced by a sliding member 25.

A configuration without heater of the pressure unit side as in the present embodiment executes the fixation by supply the heat from the external heating unit to the fixing roller, and is applicable for example to an apparatus capable of basically reducing a preliminary rotation time, for example, by adopting a lower process speed or by a lower fixing temperature, and can be effective for cost reduction by decreasing the number of parts such as the heat source.

Also in the present embodiment, the releasing property is constructed similarly in such a manner that: "high">"external heating unit">"pressure unit">"low" thereby preventing an image defect resulting from an offsetting and maintaining a satisfactory fixing property over a prolonged period.

Also in the pressure unit, a slidable member employed instead of a heater allows to use an inexpensive material with a higher freedom of working, and it is possible to easily adjust a shape, a pressurizing direction, a separating direction etc. or to integrally form the slidable member 25 and the film guide 22 thereby attaining a further inexpensive configuration.

(Embodiment 5)

Figure 5:
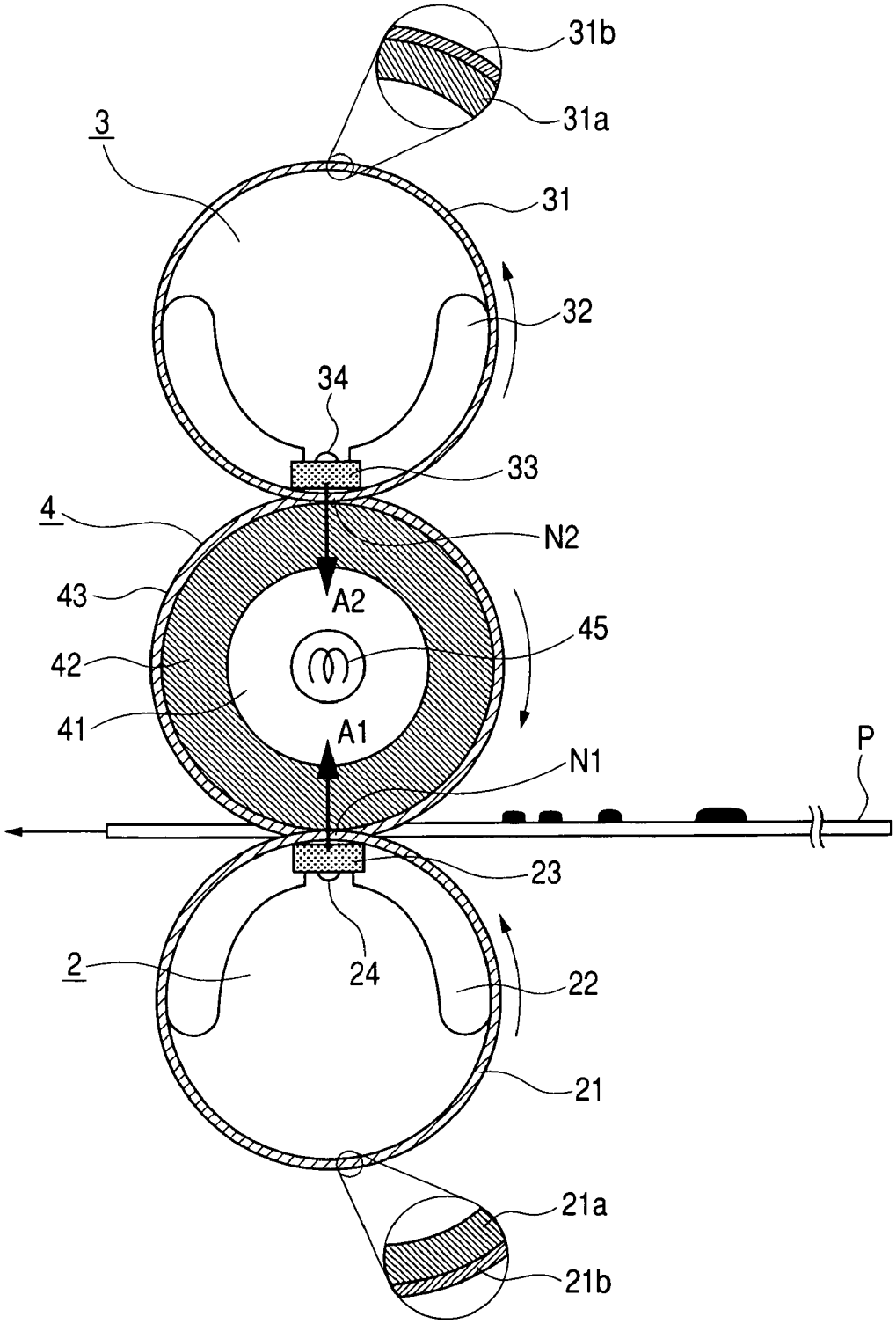
FIG. 5 is a cross-sectional view of a fixing apparatus of a fourth embodiment.

FIG. 5 shows a fifth configuration.

In the present embodiment, the fixing roller 1 in the first embodiment is replaced by a fixing roller 4 which is formed by a hollow metal roller 41 such as of iron or aluminum, provided thereon with an elastic layer 42 and a releasing layer 43, and which is provided therein with a halogen heater 45.

A configuration of the present embodiment, having a heat source in the fixing roller in addition to the external heating unit and the pressure unit allows to vary the operation so as to maintain a stable temperature depending on a state or a sheet passing mode of the apparatus, for example, preventing a temperature decrease by a heat supply principally from the external heating unit and the pressure unit, for example, in a start-up state or at a timing immediately after the start of sheet passing, and executing a stable heat supply principally from the interior of the fixing roller for example in a continuous sheet passing operation of a large amount of sheets.

Also in the present embodiment, the releasing property is constructed similarly in such a manner that: "high">"external heating unit">"pressure unit">"low" thereby preventing an image defect resulting from an offsetting and maintaining a satisfactory fixing property over a prolonged period.

(Others)

1) Each rotary member is not limited to a roller member but can also be formed as a rotary belt member.
2) Films of the pressure unit and the external heating unit are not limited to those of a resinous material, but can also be formed by thin flexible metal sleeves. Also the films of the pressure unit and the external heating unit are not limited to those driven by the rotation of the fixing roller, but may be so constructed as to be driven independently.
3) The heat generating member is not limited to a ceramic heater, but can also be formed, for example, by a heat generating member by electromagnetic induction. The heat generating member need not necessarily be positioned at the fixing nip portion N1 or the heating nip portion N2. It is also possible to generate heat in the film itself by electromagnetic induction.

4) The image heating apparatus of the present invention is usable not only in the heat fixation apparatus of the foregoing embodiments, but also in an image heating apparatus for temporary image fixation, or in an image heating apparatus for reheating an image-bearing recording material thereby improving a surface property such as a luster.

5) The second and third rotary members are not limited to flexible ones but can also be formed by rollers without flexibility. However, in order to reduce the heat capacity of the apparatus, it is preferable to employ a flexible member for at least the third rotary member.

The present invention is not limited to the foregoing embodiments but includes modifications and variations within the technical concept of the present invention.

What is claimed is:

1. An image heating apparatus for heating an image formed on a recording material, comprising:

a first rotatable member;

a second rotatable member contacting said first rotatable member, wherein a recording material passes between said first rotatable member and said second rotatable member; and heating means which heats said first rotatable member, said heating means having a third rotatable member contacting a surface of said first rotatable member;

wherein releasability of a surface of said third rotatable member is higher than releasability of a surface of said second rotatable member.

2. An image heating apparatus according to claim 1, wherein said third rotatable member has flexibility.

3. An image heating apparatus according to claim 1, wherein said heating means includes a heater for forming a heating nip portion together with said first rotatable member through said third rotatable member.

4. An image heating apparatus according to claim 3, wherein said first rotatable member includes a roller without flexibility.

5. An image heating apparatus according to claim 4, wherein said roller includes a heater therein.

6. An image heating apparatus according to claim 1, wherein said second rotatable member has flexibility.

7. An image heating apparatus according to claim 6, wherein said apparatus further comprises a sliding member for forming a conveying nip for a recording member together with said first rotatable member through said second rotatable member.

8. An image heating apparatus according to claim 7, wherein said sliding member is a heater.

9. An image heating apparatus according to claim 1, wherein releasability of a surface of said first rotatable member is higher than releasability of a surface of said second rotatable member and lower than releasability of a surface of said third rotatable member.

* * * * *